United States Patent [19]

Yurdin

[11] 4,372,551

[45] Feb. 8, 1983

[54] CARDIAC STRESS TABLE

[75] Inventor: Carl Yurdin, Port Washington, N.Y.

[73] Assignee: Victoreen, Inc., Cleveland, Ohio

[21] Appl. No.: 211,266

[22] Filed: Nov. 28, 1980

[51] Int. Cl.[3] ..... A63B 23/04; A63B 69/6

[52] U.S. Cl. ..... 972/73; 272/134; 269/322; 128/70; 128/707

[58] Field of Search ..... 272/73; 128/707, 70, 128/68; 269/322-328

[56] References Cited

U.S. PATENT DOCUMENTS

| | | | |
|---|---|---|---|
| 2,484,153 | 10/1949 | Chaudoir, Sr. | 272/73 |
| 2,784,591 | 3/1957 | Shoor | 272/73 |
| 3,189,344 | 6/1965 | Swarts | 272/73 |
| 3,540,435 | 11/1970 | Smith | 272/73 |
| 3,744,480 | 7/1973 | Gause et al. | 128/707 |
| 4,170,988 | 10/1979 | Krause | 128/68 |
| 4,230,100 | 10/1980 | Moon | 128/70 |
| 4,285,515 | 8/1981 | Gezari | 128/707 |

*Primary Examiner*—Kyle L. Howell
*Assistant Examiner*—Nancy A. Swisher
*Attorney, Agent, or Firm*—Wilson, Fraser, Barker & Clemens

[57] ABSTRACT

A device for supporting a patient in restrained positions on a supporting table pivotally interconnected to a base frame. The table is selectively positionable relative to the frame and includes elements for retaining the patient on the table. A stress imposing unit is provided at one end of the table.

10 Claims, 4 Drawing Figures

CARDIAC STRESS TABLE

BACKGROUND OF THE INVENTION

1. Field of the Invention

The present invention relates in general to medical stress measuring systems and in particular to a nuclear cardiac imaging stress table.

2. Description of the Prior Art

A wide variety of medical instrumentation is available to the modern physician to aid in the diagnosis and treatment of his patients. One well known method of patient care is the use of gamma-ray scanning, wherein a patient is exposed to the electromagnetic radiation emitted by the decay of a radioactive substance and an image is obtained therefrom. Such scanning, or imaging, requires that the patient be kept generally motionless. In the past, the patient was merely placed on a flat table to support him while the camera was moved about to obtain different images. Because the gamma-ray cameras are typically large and difficult to move, imaging tables of the prior art were adapted to be pivotally supported upon a frame so as to perit the bed to rotate relative to the camera. Another form of patient care is stress testing. Stress testing is a common method of evaluating the cardiac system of a patient. During such a test, a patient is put under stress, typically by exercising on a treadmill, while his cardiac and respiratory functions are monitored by the physician.

SUMMARY OF THE INVENTION

The present invention relates to a nuclear cardiac imaging stress table which combines the traditional stress system features with solutions to the unique demands associated with nuclear cardiac imaging. The unit includes a frame which pivotally interconnects with a patient supporting table having a slightly curved back support and pairs of adjustable shoulder supports, strap supports, and hand grips for firmly retaining a patient in position. For stress testing, the patient sits on a removable seat and operates a pedal actuated stress imposing unit with his feet. The stress imposing unit can be positioned relative to the frame by a worm-gear drive mechanism to adequately selectively accomodate the overall unit for patients of varying sizes. The entire table is adapted to rotate or pivot within the supporting frame from the vertical to the horizontal position. A suitable worm-gear mechanism is provided to selectively position the table relative to the frame. To convert the unit into a standard imaging table, the seat is removed and the pedal actuated stress imposing unit is moved to a retracted position. A leg support extension is inserted in the seat holder to support the legs of the patient generally in the plane defined by the back support.

It is an object of the present invention to provide a combination nuclear cardiac imaging table and stress testing system.

It is another object of the present invention to provide a cardiac stress table capable of being rotated or pivoted from a vertical to a horizontal position.

It is a further object of the present invention to provide a system which is fully mobile and easily adjustable to accommodate patients of varying sizes.

BRIEF DESCRIPTION OF THE DRAWINGS

Other objects and advantages will become apparent to those skilled in the art from the following detailed description of the preferred embodiments when read in light of the accompanying drawings, wherein.

DETAILED DESCRIPTION OF THE PREFERRED EMBODIMENTS

Figure 1:
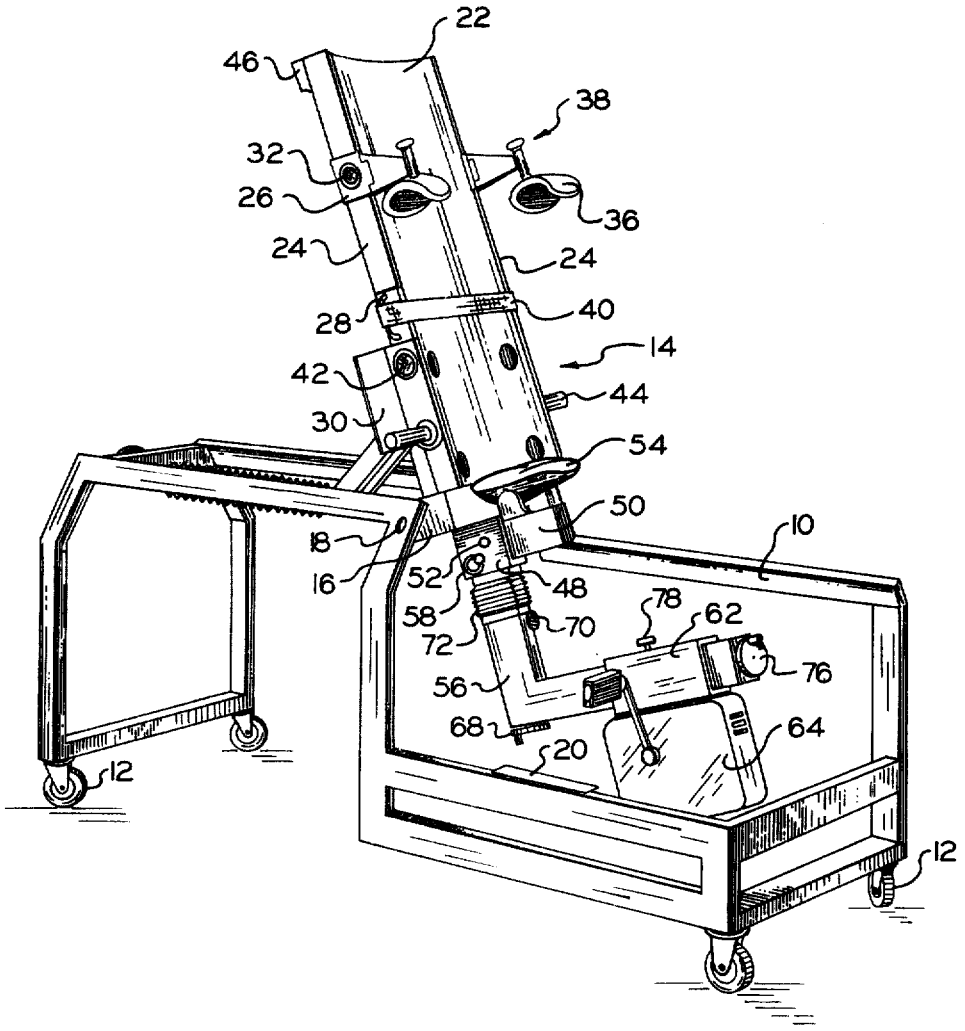
FIG. 1 is a perspective view of a cardiac stress table constructed in accordance with the present invention.

Referring now to FIG. 1, there is illustrated a cardiac stress table constructed in accordance with the present invention having a frame 10 supported by a plurality of floor engaging casters 12. The frame 10 is generally open about its base so as to permit a gamma-ray or other medical equipment (not shown) to be freely positioned about it. The frame 10 encloses a patient supporting table 14 and a means for pivotally interconnecting the frame 10 to the table 14. In the illustrated embodiment, the table 14 is pivotally secured to the frame 10 by a support member 16 extending transversely of the table 14 and has the opposite ends thereof adapted to pivot about the points 18. The frame 10 is provided with a step member 20 to aid the patient in mounting the table 14.

The table 14 includes an extended back support 22 which is slightly curved to provide a more comfortable surface for the patient and to militate against lateral movement of the patient relative to the support 22. The back support 22 is attached to and extends upwardly from the support member 16. A longitudinally extending rail member 24 is attached to each side of the back support 22. Each of the rail members 24 is adapted to slidably mount flanged means for retaining the patient on the table, such as shoulder retainers 26, strap retainers 28 and hand grips 30. The shoulder retainers 26 are provided with hand screw fasteners 32 which may frictionally engage the rail members 24 and hold the shoulder retainers 26 in desired positions. Each retainer 26 has a shoulder pad 36 and includes an adjustment mechanism, indicated generally at 38, which adjusts the position of the shoulder pads 36 longitudinally over short distances to ensure firm contract with the shoulders of the patient. The adjustment mechanism 38 is conventional in the art and forms no part of the present invention. Similarly, the strap retainer 28 may be provided with a hand screw fastener similar to the fastener 32 which may also be tightened to frictionally engage the rail member 24 to hold the strap retainer 28 in selected position. The two strap retainers 28 define a path over which a strap 40 is placed. The strap 40 can be tightened to fit snugly about and retain the patient's upper torso. The hand grips 30 also are provided with a hand screw fastener 42 for securing the hand grips 30 in desired positions. Each hand grip 30 includes a handle 44 extending outwardly therefrom for providing the patient with a stabilizing hand support. At the uppermost end of the back support 22 is attached a stop member 46 which engages the frame 10 when the back support 22 is in the horizontal position.

The support member 16 also is provided with a mounting bracket 48 for removably receiving a seat base 50. A locking pin 52 extends through suitable apertures formed in the mounting bracket 48 and the seat base 50 for securing a padded seat 54 in selected position, thus providing the patient with a place to sit when the table assembly 14 is in an upright position. Means for supporting a stress imposing unit at one end of the table 14 such as an L-shaped support member 56, is pivotally mounted on the support member 16. The support member 56 is held in an extended position (see FIG. 2) by a locking pin 58 which extends through suitable apertures provided in the mounting bracket 48 and the support member 56. When the pin 58 is removed, the L-shaped support member 56 can be rotated downwardly into a retracted position (see FIG. 3). When the support member 56 is in the retracted position, the seat base 50 is removed and replaced by a leg support extension 60 as shown in FIG. 3. This structure permits the patient to lie flat on the table 14 for standard imaging procedures.

The L-shaped support member 56 slidably supports a housing 62 having a removable pedal unit 64. The pedal unit 64 provides a means for imposing a stress load to the patient and is well known in the art. As most clearly illustrated in FIG. 2, the position of the pedal unit 64 can be varied with respect to the back support 22 and the seat 54. A first worm-gear drive mechanism 66 is operated by rotating a first hand crank 68 which imparts linear movement to the outer portion of the support member 56 in a conventional manner. When the desired location is reached, a set screw 70 is tightened to frictionally engage the worm-gear drive mechanism 66 to militate against any undesired movement. A bellows 72, preferably formed of a heavy flexible plastic or rubber, covers the moving parts of the worm-gear drive mechanism 66 and protects the patient and physician from harm arising from unintended contact. Similarly, a second worm-gear drive mechanism 74, operated by the rotation of a second hand crank 76, imparts linear motion to the housing 62 along the lower leg of the L-shaped support member 56. A set screw 78 can be tightened to frictionally engage the worm-gear drive 74 to militate against any undesired movement. Thus, it will be appreciated that the pedal unit 64 can be moved both longitudinally and transversely to a position where a patient can operate it comfortably and out of the way of other medical equipment such as a gamma-ray camera.

The entire table 14 can be rotated from horizontal positions to vertical positions by pivoting the support member 16 about the pivot points 18 formed in the frame 10. These positions, as well as any intermediate positions, may be provided by a helical screw means 80 which drivingly engages a large drive nut 82 which is driven linearly as the screw 80 is rotated by a hand crank 84. The helical screw means 80 may be covered by a flexible bellows 86. The nut 82 is suitably connected to a linkage 88 which is secured at its opposite end to the lower end of the back support 22 by any suitable means. It will be appreciated that by rotating the hand crank 84, thus rotating the screw 80, the drive nut 82 and linkage 88 will move linearly along the screw 80 to rotatably move the back support 22 about the pivot points 18 on the frame 10.

Figure 2:
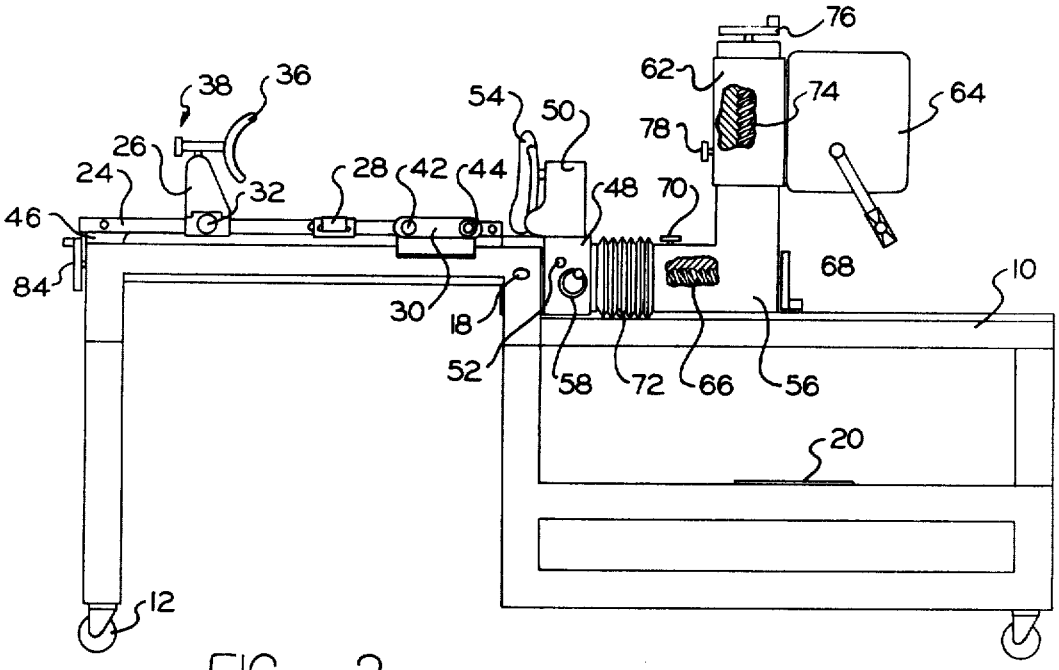
FIG. 2 is a side elevational view, partially broken away, of the table illustrated in FIG. 1.
Figure 3:
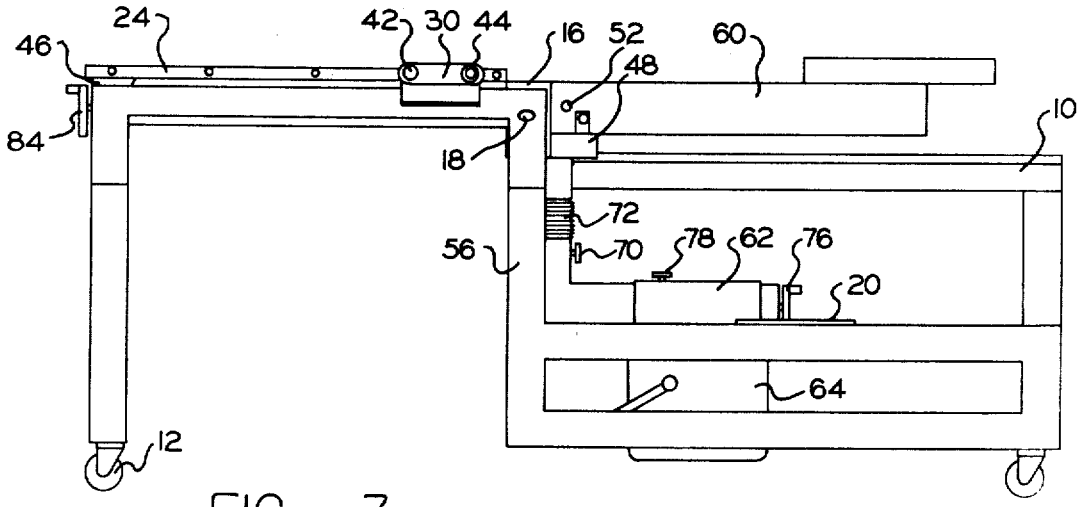
FIG. 3 is a side elevational view of an alternate embodiment of the present invention.
Figure 4:
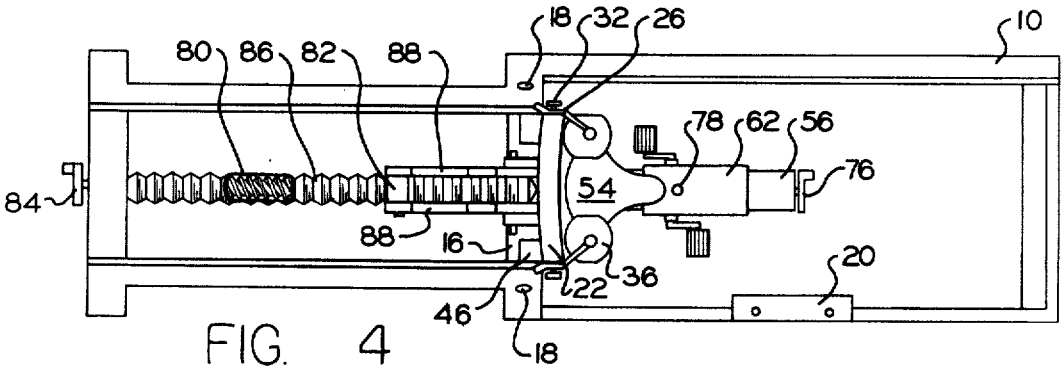
FIG. 4 is a plan view, partially broken away, of the table of FIG. 1.

To utilize the present invention as a cardiac stress system, the seat base 50 and the seat 54 are mounted in mounting brackets 48 and the support member 56 is affixed in its extended position as illustrated in FIGS. 1 and 2. The patient utilizes the foot pad 20 to reach the table 14 and the seat 54. Once the patient has assumed a comfortable position on the table 14, the shoulder retainers 26 and the strap 40 will be adjusted and tightened respectively to firmly hold the upper torso of the patient in a restrained position. The pedal unit 64 will be moved to an appropriate position by operating the hand crank 68 and 76. Various sensors may be attached to the patient to monitor his cardiac and respiratory functions. The table 14 can be rotated from the vertical to the horizontal or to any intermediate position as desired by the physician. As the patient is put under stress, his performance can be monitored by the sensing devices or by a gamma-ray camera placed near the table assembly 14 while his upper torso remains essentially motionless.

In its alternate embodiment, the present invention provides a flat table for standard imaging procedures. In this embodiment, the pin 58 is removed so that the support member 56 can be rotated downwardly into the retracted position. The pin 52 is also removed so that the seat base 50 and the padded seat 54 can be removed from the mounting bracket 48. The leg support extension 60 is then mounted in the bracket 48 and the pin 52 is re-inserted through the apertures. The table assembly 14 thereby provides a flat surface upon which the patient may lie for a standard scanning procedure.

In accordance with the provisions of the patent statues, the principle and mode of operation of the invention have been explained in its preferred embodiment. However, it is to be understood that the invention may be practiced otherwise than as specifically illustrated and described without departing from its spirit or scope.

What is claimed is:

1. A cardiac stress table comprising:

a frame;

a one-piece patient supporting table including a back support and extending through a seat portion, means for retaining a patient on said table, and means supporting a stress imposing unit integral with and extending longitudinally from said table;

means for pivotally interconnecting said table to said frame permitting rotation of said table and said stress imposing means from a generally horizontal position to a generally vertical position to effectively move a supported patient from a sublime position to an upright position during periods of examination; and means for selectively positioning and maintaining said table relative to said frame through approximately ninety degrees to achieve adjustment of said supporting table at any position from the horizontal position to the vertical position.

2. The invention defined in claim 1 wherein said means for selective positioning includes a threaded screw means.

3. The invention defined in claim 2 wherein said threaded screw means cooperates with a drive linkage connected to apply force to said table.

4. The invention defined in claim 1 wherein said retaining means includes shoulder retaining means.

5. The invention defined in claim 4 wherein said retaining means further includes hand grip means provided in spaced relation from said shoulder retaining means.

6. The invention defined in claim 1 wherein said retaining means includes a removable seat.

7. The invention defined in claim 1 wherein said means for supporting a stress imposing unit is rotatably secured to said table.

8. The invention in claim 1 wherein said means for supporting a stress imposing unit includes means for longitudinally and transversely positioning said stress supporting unit relative to said table.

9. The invention defined in claim 8 wherein said positioning means includes a worm-gear drive mechanism.

10. The invention in claim 1 wherein said stress imposing unit is a foot pedal operating means.

* * * * *